US009511472B2

(12) United States Patent
Zapp et al.

(10) Patent No.: US 9,511,472 B2
(45) Date of Patent: Dec. 6, 2016

(54) MODULAR DUAL-ACTION DEVICES AND RELATED METHODS

(75) Inventors: Kenneth J. Zapp, Trabuco Canyon, CA (US); James R. Williamson, Lakewood, CA (US); Brian P. Dutkiewicz, Huntington Beach, CA (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/232,932

(22) PCT Filed: Jul. 19, 2012

(86) PCT No.: PCT/US2012/047352

§ 371 (c)(1),
(2), (4) Date: Jan. 15, 2014

(87) PCT Pub. No.: WO2013/016123

PCT Pub. Date: Jan. 31, 2013

(65) Prior Publication Data

US 2014/0187127 A1 Jul. 3, 2014

Related U.S. Application Data

(60) Provisional application No. 61/511,736, filed on Jul. 26, 2011.

(51) Int. Cl.
*B24B 23/03* (2006.01)
*B24B 47/12* (2006.01)
(Continued)

(52) U.S. Cl.
CPC ..... *B24B 41/047* (2013.01); *B24B 23/022* (2013.01); *B24B 23/03* (2013.01); *B24B 47/12* (2013.01)

(58) Field of Classification Search
CPC ..... B24B 23/005; B24B 23/02; B24B 23/022; B24B 23/03; B24B 41/047; B24B 47/12
(Continued)

(56) References Cited

U.S. PATENT DOCUMENTS 2,492,372 A * 12/1949 Smith ..... 451/356
2,722,789 A * 11/1955 Robins ..... 451/356
(Continued)

FOREIGN PATENT DOCUMENTS

DE 9111520 1/1993
DE 10134308 1/2003
(Continued)

OTHER PUBLICATIONS

International Search Report for PCT International Application No. PCT/US2012/047352 Mailed on Oct. 5, 2012, 6 pages.

*Primary Examiner* — Eileen Morgan
(74) *Attorney, Agent, or Firm* — Philip P. Soo

(57) ABSTRACT

The invention concerns a module (100) adapted for use with a hand-held power drill (200) for dual-action abrading, polishing, and/or cleaning of a substrate. The module (100) uses a direct drive mechanism whereby rotation of a suitable work member (204) is actuated along a circular orbital path. The module (100) optionally includes a handle (114) coupled to the module (100), which allows the spindle (110) motion induced by the power drill (200) and the motion of the housing (102) to be effectively decoupled from each other and enhances operator control over the work member (204). Providing a modular device (100) that can be used with a common household tool results in an increased versatility as well as space and cost savings for the consumer.

18 Claims, 5 Drawing Sheets

(51) Int. Cl.
*B24B 41/047* (2006.01)
*B24B 23/02* (2006.01)

(58) Field of Classification Search
USPC ..... 451/357, 59, 441
See application file for complete search history.

(56) References Cited

U.S. PATENT DOCUMENTS

| | | | | | |
|---|---|---|---|---|---|
| 4,610,111 | A | * | 9/1986 | Cox | 451/357 |
| 5,056,268 | A | * | 10/1991 | Wolff | 451/357 |
| 5,349,786 | A | * | 9/1994 | Dorrah | 451/357 |
| 5,464,367 | A | * | 11/1995 | Zink, Jr. | 451/441 |
| 5,980,371 | A | * | 11/1999 | McConnell | 451/352 |
| 6,009,767 | A | * | 1/2000 | Rudolph | 74/86 |
| 6,579,161 | B1 | | 6/2003 | Chesley | |
| 6,634,437 | B1 | * | 10/2003 | Rudolph | 173/1 |
| 6,890,247 | B2 | | 5/2005 | Dehde | |
| 7,399,140 | B2 | * | 7/2008 | Barcenas | 404/112 |
| 7,892,073 | B1 | * | 2/2011 | Smania et al. | 451/50 |
| 8,845,397 | B1 | * | 9/2014 | LeFever et al. | 451/342 |
| 2002/0077038 | A1 | * | 6/2002 | Stegner | 451/41 |
| 2005/0272360 | A1 | * | 12/2005 | Tyranowski | 451/496 |

FOREIGN PATENT DOCUMENTS

| | | |
|---|---|---|
| GB | 677518 | 8/1952 |
| JP | 56027773 | 3/1981 |

* cited by examiner

MODULAR DUAL-ACTION DEVICES AND RELATED METHODS

CROSS REFRENCE TO RELATED APPLICATIONS

This application is a national stage filing under 35 U.S.C. 371 of PCT/US2012/047352, filed Jul. 19, 2012, which claims priority to Provisional Application Ser. No. 61/511,736, filed Jul. 26, 2011, the disclosure of which is incorporated by reference in its/their entirety herein.

FIELD OF THE INVENTION

Modular devices, kits and methods are provided for processing a substrate. More particularly, modular devices, kits and methods are provided for performing orbital rotation (dual-action) processing on a substrate.

BACKGROUND

Rotary sanders, grinders, polishers, buffers, and cleaners are used in a wide range of applications, including carpentry, metal working, vehicle detailing, and vehicle repair. These tools can also be used with diverse substrates, including marble, glass, upholstery, wood, metal and painted surfaces. The tools are sometimes adapted for specialized applications, for example when there is risk of damaging the substrate. One such application is in automotive and marine exterior detailing. Car exteriors typically include several layers of paint, which are then topped with a protective clear coat layer. Boats typically utilize a gel coat in lieu of the protective clear coat layer that may be treated in a similar fashion to automotive finishes. To obtain an aesthetically pleasing shine, car enthusiasts apply a wax or liquid polish composition to the exterior of the car and then use a rotary polisher to spread the composition and remove swirls and minor scratches from the clear coat layer.

Simple rotary (or "single-action") polishers use a work member that rapidly spins about a fixed axis of rotation relative to the polishing device. While these devices are capable of polishing the substrate at a high cut rates, this action can also generate significant heat because the polishing head rotates at such high speeds. In the hands of an untrained operator, a single-action polisher can generate enough heat to risk "burning" the paint, which refers to the undesirable removal of paint residing below the clear coat surface. Decreasing the rotational speed of the work member can reduce this risk, but doing so can also reduce polishing efficiency below acceptable levels.

The risks associated with a single-action polisher can be substantially mitigated while maintaining polishing efficiency by using an oscillating, dual-action polisher. Dual action polishers use a work member that spins about a central spindle, while the spindle itself rotates around an eccentric offset. Like a planet orbiting around the sun, the head of a dual-action polisher spins about a first axis while orbiting around a second axis displaced from the first axis. For this reason, these dual-action devices are also sometimes referred to as orbital polishers. The combined rotating/orbiting motion dissipates heat and can effectively prevent the polisher from burning the paint. This safety feature makes dual-action devices an attractive option for hobbyists and professionals alike.

SUMMARY OF THE INVENTION

Conventional dual-action devices use a freely-rotating work member (or head unit) coupled to an orbital mechanism. This mechanism is powered by a dedicated drive motor that operates at high speeds, typically in excess of 8,000-10,000 rotations per minute (rpm). These high orbital speeds are sufficient to induce self-rotation of the work member about the second axis based on the inertia of the work member as it is flung around in its orbital motion about the first axis.

While the inertial drive mechanism can produce satisfactory results at high drive speeds (e.g. in the range of 8,000-10,000 rpm), the mechanism encounters performance limitations at lower drive speeds. At lower drive speeds, the orbital speed is also lower, which significantly reduces the driving force that rotates the work member. Since the driving force is reduced, friction between the work member and the substrate can retard or halt entirely the rotation of the work member, resulting in poor performance. The manufacturer of the device thus faces an unfortunate dilemma. While the diameter of the work member can be substantially reduced to lower the drag on the work member, this forces the operator to make additional passes to get the same job done. Use of intermediate diameters with higher orbital speeds might be feasible, but this approach increases power consumption and potentially limits the scope of applications for the device. Obviously, none of these options are ideal.

The provided devices and methods overcome the above problem by using a direct drive (or a forced rotation) mechanism that enables the dual-action motion to be provided by a modular component releasably coupled to an external drive motor. This approach conveniently enables the device to be used with household power drills, which typically operate at relatively low drive speeds not exceeding 2,500 rpm. These devices optionally include a handle attached to the housing, which allows the spindle motion driven by the drive motor and the motion of the housing to be effectively decoupled from each other. The handle can be positioned close to the substrate, thus providing enhanced operator control over the dual-action head unit. By providing a modular device that can be used with a common household tool, these devices and methods provide for increased versatility as well as space and cost savings to the consumer.

In one aspect, a module adapted for use with a handheld power drill comprising: a housing having first and second sides; a rotatable spindle extending outwardly from the first side, the spindle having an outer end adapted for releasable coupling to the power drill; a direct drive mechanism coupled to the spindle; and a backing plate located adjacent the second side and engaged to the direct drive mechanism whereby rotation of the spindle directly drives rotation of the backing plate, the rotation occurring along a circular orbital path relative to the housing.

In another aspect, a dual-action device kit is provided, comprising: a module adapted for use with a handheld power drill, the module comprising: a housing having first and second sides;

a rotatable spindle extending outwardly from the first side, the spindle having an outer end adapted for releasable coupling to the drill device; and a backing plate adjacent the second side and engaged to the spindle wherein rotation of the spindle causes the backing plate to rotate along a circular orbital path relative to the housing.

In still another aspect, a method of processing a substrate comprising: providing a module having a housing, a rotatable spindle extending outwardly from a first side of the housing and received in the housing, a handle coupled to the housing, and a work member engaged to the spindle and extending along a second side of the housing; releasably coupling a handheld power drill to the spindle; placing the work member against the substrate; and rotating the work member, using the drill device, along a circular orbital path across the surface of the substrate while holding the handle to prevent rotation of the module.

DETAILED DESCRIPTION

Figure 1:
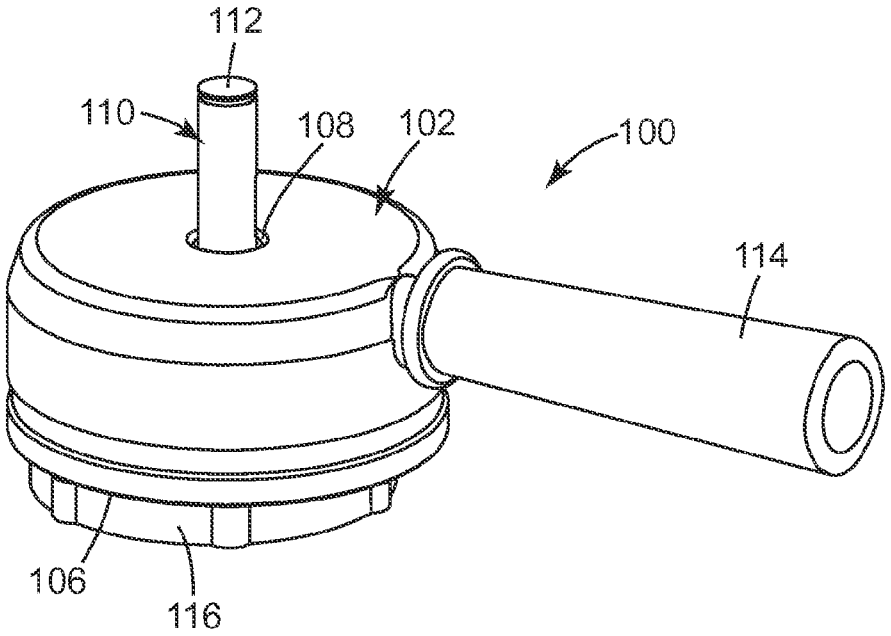
FIG. 1 is a perspective view looking at the top and side surfaces of a dual-action module for a handheld power drill according to one exemplary embodiment.

The provided dual-action modules, related kits and methods are further described herein by way of illustration and example. In exemplary embodiments, these dual-action modules are capable of being coupled to a handheld power drill and are usable in applications including, but not limited to, sanding, compounding, cleaning, polishing, waxing and buffing automotive and marine exteriors. Analogous uses could exist in metal finishing, upholstery cleaning, and wood working A module according to one exemplary embodiment is shown in FIG. 1 and broadly designated by the numeral 100. The module 100 includes a housing 102, the housing 102 having at least two sides, such as a top side 104 and a bottom side 106. As used herein, it is to be understood that the terms "top" and "bottom" are merely used in a relative sense and the exact location of the sides can be any suitable location, such as top, bottom, left, right, etc.

In the illustrated embodiment the top side 104 is disposed generally opposite the bottom side 106. One or both of the top and bottom sides 104, 106 may be planar or curved. In one embodiment, the top and bottom sides 104 and 106 are planar and parallel to each other. The housing 102 as shown has a generally cylindrical shaped wall section, but other suitable shapes are within the scope of the present disclosure. For example, the housing 102 could optionally have a square or hexagonal cross-section.

As shown, the top side 104 has an aperture 108 located in the top side 104. As used herein, the term "aperture" refers to a passageway extending partially or entirely through a given object. In exemplary embodiments, the aperture 108 may be symmetrically disposed about the cylindrical axis of the housing 102. For example, the aperture may be circular and it may be disposed at the geometric center of the top side 104.

A rotatable spindle 110 extends outwardly through the aperture 108, protruding in a direction perpendicular to the top side 104 of the housing 102. In some embodiments, the spindle 110 extends at an acute angle relative to the top side 104 or has one or more flexible joints allowing the longitudinal axis of the spindle 110 to change along its length. The spindle 110 has an outer end 112 adapted for releasable coupling to a power drill (not shown in this figure). In some embodiments, the outer end 112 has a diameter of about 0.25 inches (6.35 millimeters) or less. As used herein, the term "diameter" refers to the widest lateral dimension of an object, which need not be circular. In this case, the lateral dimension is measured along a cross-sectional plane perpendicular to the longitudinal axis of the spindle 110. The outer end 112 can have a round or polygonal cross-sectional shape. In some embodiments, the outer end has a hexagonal cross-section to facilitate engagement to common household power drills.

As further shown in FIG. 1, a handle 114 is coupled to the housing 102 and extends outwardly from the housing 102 in a lateral direction. Optionally, the handle 114 could be made integral with the housing 102. The handle 114 facilitates control of the module 100 by allowing an operator to grasp the handle 114 on the housing 102 with one hand while operating the power drill with the other hand. Because of the close proximity of the handle 114 to the substrate being acted upon by the module 100, gripping the handle 114 and power drill together affords the operator a significantly greater degree of control than gripping the power drill alone. As used herein, the term "substrate" generically refers to an outer surface of a workpiece that is acted upon by the module 100.

Figure 2:
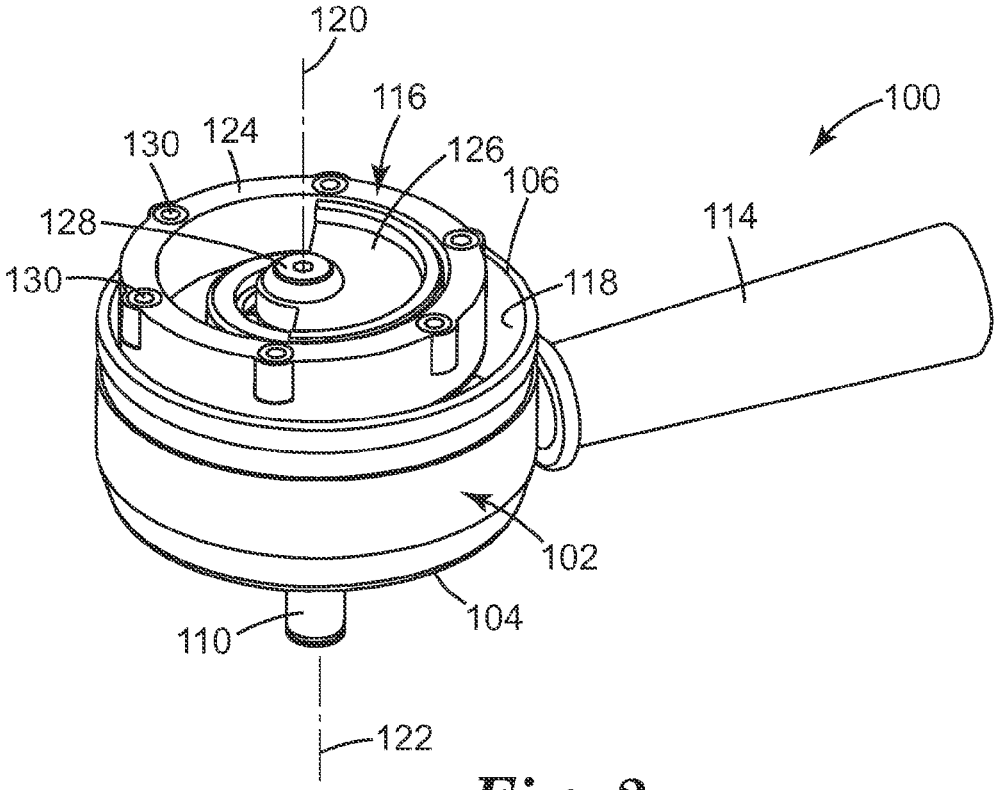
FIG. 2 is a perspective view looking at the bottom and side surfaces of the module of FIG. 1.
Figure 3:
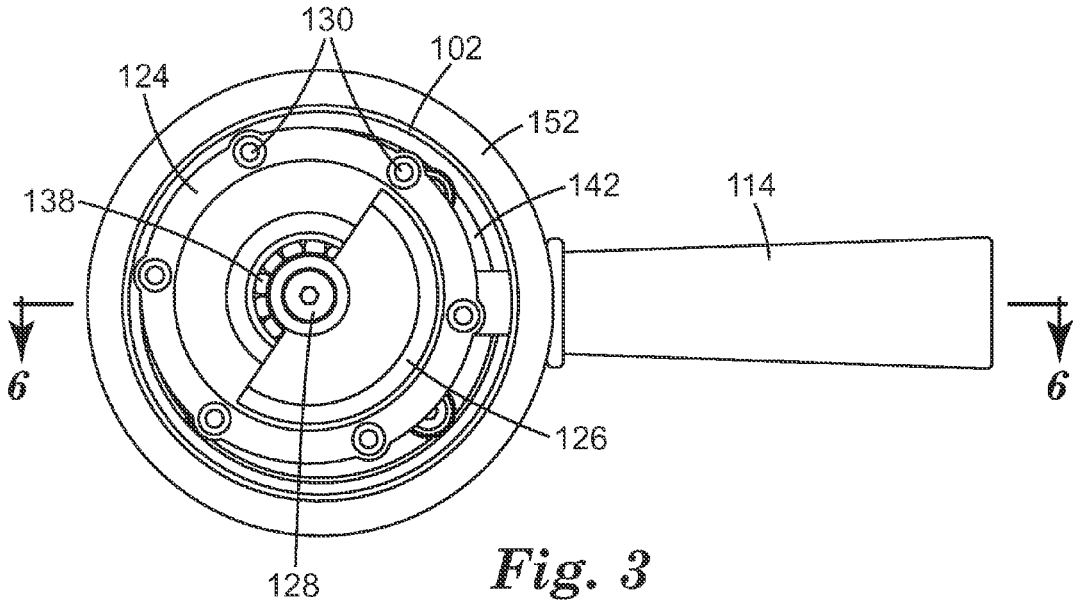
FIG. 3 is a plan view looking at the bottom side of the module of FIGS. 1-2.

Adjacent to and extending slightly past the bottom side 106 of the housing 102 is a dual-action assembly 116. Additional details of the assembly 116 are shown in FIGS. 2 and 3. In these figures the module 100 is inverted, showing bottom-facing components of the assembly 116. As shown in FIG. 2, the assembly 116 partially resides in a cavity 118 located on the bottom side 106 of the housing 102.

Like the housing 102, the assembly 116 also has a generally cylindrical configuration. However, the diameter of the assembly 116 is smaller than that of the cavity 118, allowing the assembly 116 to rotate about a first axis 120 that represents the cylindrical axis of the assembly 116 while simultaneously orbiting about a second axis 122 that represents the cylindrical axis of the outer end 112 of the spindle 110. As shown, the axis 120 is slightly offset from the second axis 122, such that the assembly 116, as a whole, traces a circular path relative to the housing 100 during operation.

Referring to FIGS. 2 and 3, the assembly 116 includes a generally circular backing plate 124 having a planar bottom surface and a semi-circular counterweight 126 adjacent to the backing plate 124. The backing plate 124 and counterweight 126, despite rotating at different rates relative to each other, are commonly coupled to underlying components of the assembly 116 by a screw 128. The counterweight 126 has a size and weight that is precisely calibrated to compensate for the off-center disposition of the assembly 116 relative to the housing 102. By balancing the weight across the bottom side 106 of the housing 102, the counterweight 126 helps minimize flutter and wobbling of the module 100 during operation.

The backing plate 124 provides six screws 130 located along its annular rim on the bottom side of the assembly 116. The screws 130 are preferably arranged in a standardized configuration that allows the backing plate 124 to be attached to a wide variety of work members adapted to contact the substrate, or one or more intermediary components (e.g. an interface backing plate). The particular work member used depends on the desired application. Exemplary work members include abrasive discs, polishing pads, sanding pads, buffing pads, cleaning pads, and brushes.

One notable aspect of this configuration is that the second axis 122, or rotational axis of the spindle 110, forms a fixed angle with respect to the plane of the backing plate 124. Preferably and as shown, this fixed angle is about 90 degrees, such that the shaft of the power drill is perpendicular to the substrate being abraded, polished, or cleaned. This perpendicular orientation provides the operator with enhanced control over the normal force applied to the substrate by the backing plate 124.

The configuration shown improves operator control because forces applied to press the backing plate 124 against the substrate are aligned along the longitudinal axis of the spindle 110, thus avoiding the creation of a moment that could tip the backing plate 124 relative to the substrate. As a further benefit over prior art devices, each of the housing 102 and dual-action assembly 116 of the module 100 has a weight distribution that is generally symmetric about the axis 122. This also helps the operator apply even pressure across the surface of the work member.

Figure 4:
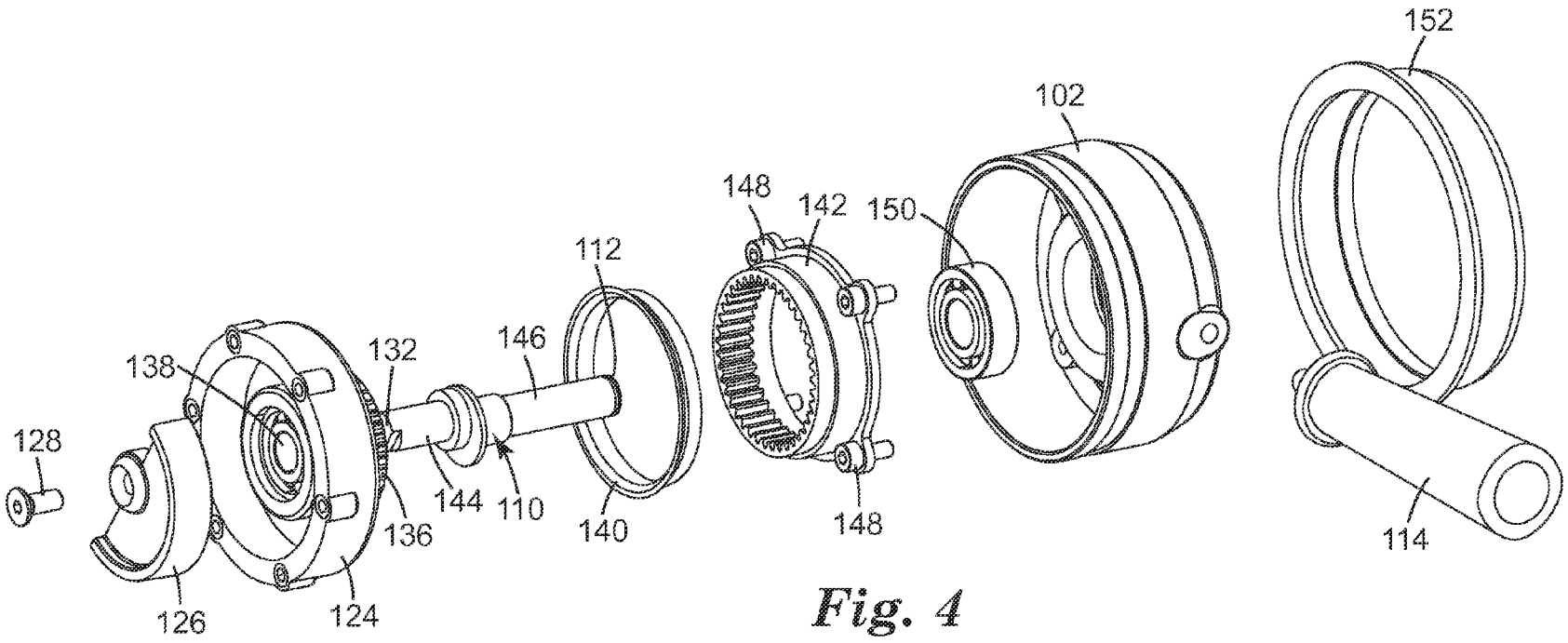
FIG. 4 is an exploded perspective view of the module of FIGS. 1-3, looking at the bottom and side surfaces of its components.
Figure 5:
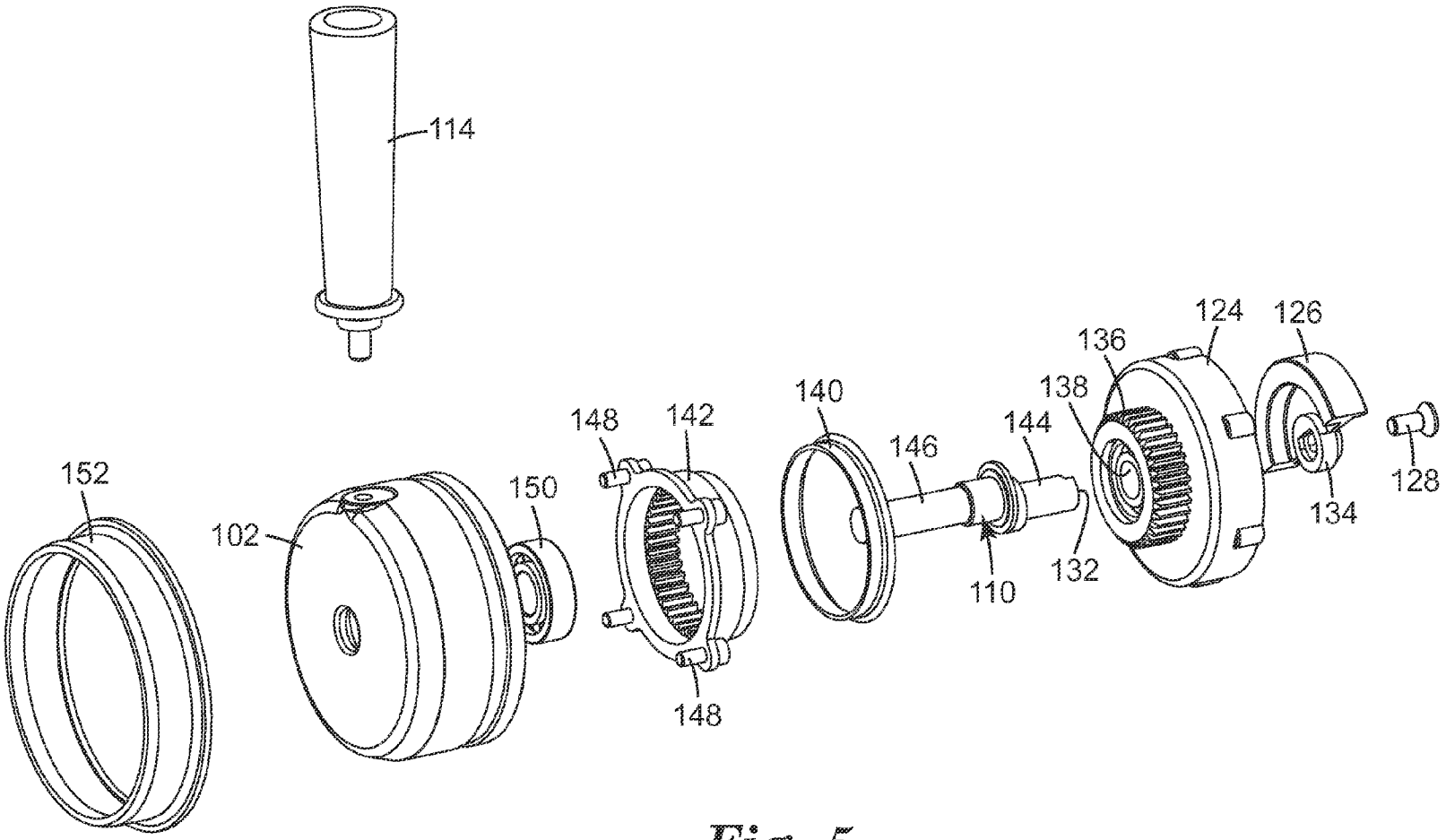
FIG. 5 is an exploded perspective view of the module of FIGS. 1-4, looking at the top and side surfaces of its components.

As illustrated in subsequent FIGS. 4 and 5, the dual-action motion of the assembly 116 is actuated by a direct drive mechanism whereby the backing plate 124 and the spindle 110 are engaged to each other. FIG. 4 presents the components of the module 100 in exploded view, showing the bottom-facing surfaces of each component. FIG. 5 is an exploded view taken from the opposite direction, showing the top-facing surfaces of each component. Unless otherwise noted, the internal components of the module 100 are preferably made from stainless steel (such as 300-series stainless steel) or polymeric composite materials. Some exterior components of the module 100, such as the housing 102, can optionally be made from aluminum.

Referring now to FIGS. 4 and 5, and starting at the bottom of the module 100, the screw 128 extends through a central aperture in the counterweight 126 and rigidly couples the counterweight 126 to the spindle 110. As shown in FIG. 5, the spindle 110 has an inner end 132 with a "D"-shaped cross-section received in a complemental "D"-shaped recess 134 in the counterweight 126, which prevents the spindle 110 and counterweight 126 from rotating relative to each other.

Optionally and as shown, the backing plate 124 is integrally connected to spur gear 136. Although illustrated here as an integral component, the gear 136 and backing plate 124 can also be discrete components that are subsequently joined together. Captured within the backing plate 124 and the gear 136 are a pair of stacked annular bearings 138, partially visible in the bottom view of FIG. 3. The bearings 138 occupy an annular space between the spindle 110 and the backing plate 124/gear 136 and help minimize friction as the backing plate 124/gear 136 collectively rotate about the spindle 110.

As seen in the figures, the spindle 110 includes a pair of non-concentric cylindrical segments 144, 146 joined together end to end. The first segment 144 extends toward the top side of the module 100 and is generally symmetric about the second axis 122 (shown in FIG. 2). The second segment 146, on the other hand, extends toward the bottom side of the module 100 and is generally symmetric about the first axis 120. As a result of this offset axis configuration, the first axis 120 orbits about the second axis 122 at a rate exactly equal to the rotation rate of the spindle 110.

Proceeding further, an annular gasket 140 and internal ring gear 142 are symmetrically disposed along the spindle 110. When the module 100 is assembled, the gasket 140 is captured in a space between the ring gear 142 and the backing plate 124. These components are mutually engaged such that gear teeth extending inwardly from the ring gear 142 mesh with gear teeth extending outwardly from the spur gear 136, causing the spur gear 136 to rotate about the first axis 120 as the first axis 120 orbits about the second axis 122. In this internal ring gear configuration, the backing plate 124 rotates about the first axis 120 in a direction counter to its orbital direction about the second axis 122. In other words, when the backing plate 124 rotates in a clockwise direction, the first axis 120 traces a circular orbital path in a counterclockwise direction.

The relative rates of rotation of the backing plate 124 and the spindle 110 are generally determined by the relative diameters of the ring gear 142 and spur gear 136. In some embodiments, the spindle 110 and the backing plate 124 rotate at different rates according to a pre-defined ratio that is at least 5:1, at least 7:1, or at least 8:1. In some embodiments, the spindle 110 and backing plate 124 rotate at different rates according to a pre-defined ratio that is at most 15:1, at most 12:1, or at most 10:1. In some embodiments, the mating gears 136, 142 are helical gears to reduce noise.

The internal ring gear 142 is then fastened to the housing 102 such that these components do not rotate relative to each other. This is accomplished here by a series of screws 148, which extend through the ring gear 142 and engage threaded apertures located on inner surfaces of the housing 102. Optionally and as shown, annular bearings 150 are also concentrically mounted within the cavity 118 of the housing 102 adjacent the aperture 108. The bearings 150 are radially disposed between the spindle 110 and the housing 102, thereby facilitating free rotation of the spindle 110 relative to the stationary ring gear 142 and housing 102.

As previously indicated, the handle 114 is directly attached the outer surface of the housing 102 and extends along a direction generally parallel to the plane of the backing plate 124. During operation of the module 100, the handle 114 allows the operator to stabilize the module 100 and prevent the housing 102 from rotating along with the spindle 110 and back plate assembly 116. The location of the handle 114 is also beneficial because the operator can grip the module 100 at a location close to the substrate being treated. This in turn provides a superior degree of control compared with a configuration where the operator only grips the power drill. Although not shown here, the handle 114 could optionally protrude from other surfaces of the housing 102 and extend in different directions depending on the desired position for the operator's hand.

Although the handle 114 serves the useful functions above, it could also be omitted. As an alternative embodiment, for example, the module 100 could include, instead of a handle, a mechanical fixture or other structure that releasably couples the housing 102 to the power drill to prevent undue rotation of the housing 102 during operation. In further embodiments, this fixture itself serves as, or includes, a handle to facilitate operator control.

Adjacent to the handle 114, and toward the bottom side of the module 100, a protective collar 152 encircles the housing 102 in a friction fit relation. In some embodiments, the collar 152 is made from a flexible polymeric material can function as a splash guard when the module 100 is being used with liquid compositions.

Figure 6:
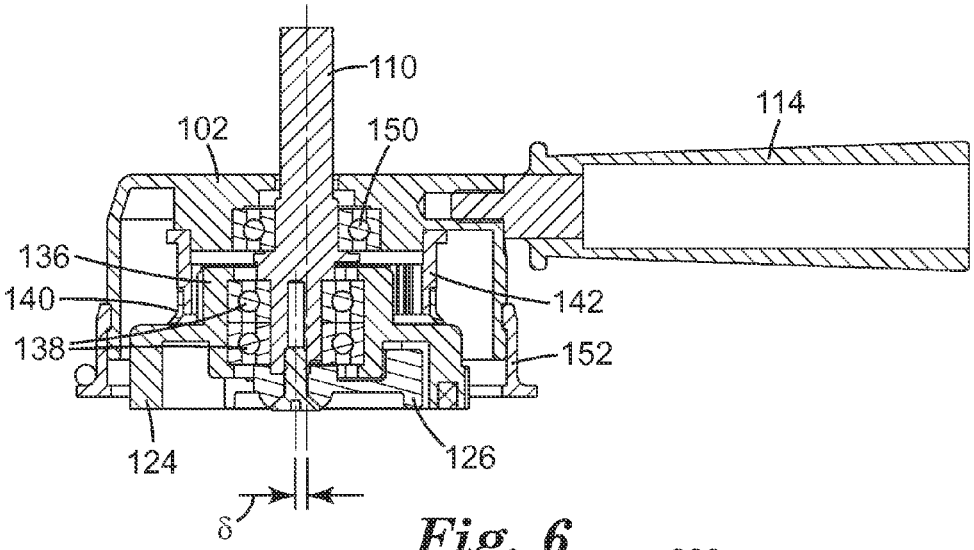
FIG. 6 is an elevational cross-sectional view of the module of FIGS. 1-5 along the line 6-6 in FIG. 3.

FIG. 6 is a cross-section taken along the line 6-6 indicated in FIG. 3 and shows the relative orientation of the above components in module 100 in assembled form. As illustrated, the geometric center of the backing plate 124 is slightly offset from the geometric center of the housing 102. The degree of offset δ, as defined in this figure, need not be large to provide the benefits of a dual action device. In some embodiments, the offset ranges from about 2 millimeters to about 20 millimeters.

Figure 7:
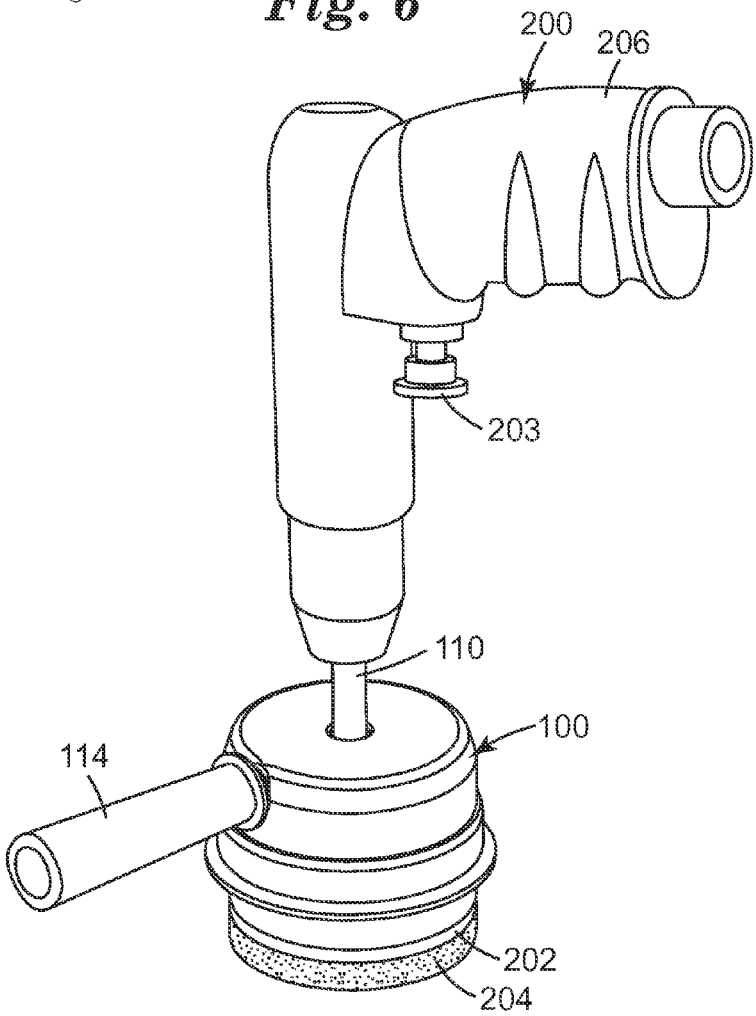
FIG. 7 is a perspective view of the module of FIGS. 1-6 coupled to the handheld power drill.

FIG. 7 shows an exemplary method of using the module 100 in conjunction with a suitable power drill 200, intermediary pad 202, and work member 204. First, the intermediary pad 202 is securely fastened to the backing plate 124 by the screws 130. Preferably and as shown, the pad 202 has a planar bottom-facing surface extending across substantially all of the backing plate 124. In some embodiments the intermediary pad 202 is a compressible pad, such as an interface pad or a back-up pad. In some embodiments, the intermediary pad 202 serves as a spacer or backing for the work member 204. Either or both the pad 202 and the work member 204 can be reusable.

Second, the work member 204 is coupled to the intermediary pad 202. Since the work member 204 directly contacts the substrate, it can be soiled or worn out quickly during use. Therefore, for the convenience of the operator, it can be advantageous for the work member 202 to be releasably coupled to the intermediary pad 202 to allow rapid replacement. It is contemplated, for example, that the intermediary pad 202 and work member 204 could have respective coupling surfaces for releasable engagement to each other. Such coupling surfaces could include for example hook and loop structures, or the mating structures described in U.S. Pat. No. 6,579,161 (Chesley et al.). Alternatively, a pressure sensitive adhesive could be used to releasably couple the intermediary pad 202 and the work member 204 to each other.

Other combinations are also possible. For example, mating coupling surfaces could additionally be used to releasably couple the backing plate 124 to the intermediary pad 202. Alternatively, the intermediary pad 202 could be omitted and coupling surfaces could be used to releasably couple the backing plate 124 directly to the work member 204.

Optionally and as shown in FIG. 7, the backing plate 124, pad 202, and work member 204 have diameters that generally match each other. However, if desired, the module 100 could optionally be used with pads and/or work members having diameters larger than the backing plate 124. In these cases, care should be taken to ensure that adequate torque is delivered to the spindle 110 in view of the increased drag resistance resulting from the larger contact area. Further, it could be beneficial for the compressible pad 202 to be made relatively stiff such that normal force applied by the backing plate 124 is distributed evenly across the polishing pad 204.

Third, the outer end of the spindle 110 is then coupled to a handheld power drill 200, as shown in FIG. 7. In a common embodiment, the working end of the power drill 200 has a universal chuck with adjustable grippers. The grippers can be expanded and contracted as needed to receive and rigidly mount the spindle 110 within the chuck. Although not shown here, other powered devices besides power drills could also engage the spindle 110 to drive the module 100.

For some applications, a composition is applied either to the bottom side of the polishing pad, to the substrate, or both, after the module 100 is mounted to the drill 200. The composition could be, for example, lubricant, wax, liquid polishing composition, or cleaning composition.

Finally, to operate the module 100, the operator grips a handle 206 of the drill 200 while simultaneously grasping the handle 114 of the module 100 to place the module 100 into contact with the substrate. The operator then depresses a trigger 208 on the drill 200 to induce rotation of the spindle 110. As the spindle 110 is rotated relative to the housing 102, the rotation directly drives rotation of the backing plate 124 along a circular orbital path relative to the housing 102. From here, the operator can laterally glide the housing 100 in a back and forth manner to abrade, polish, or clean the substrate. If desired, the operator can increase pressure on the substrate by gently urging the power drill 200 downward, while maintaining lateral control over the module using the handle 114.

A significant and unexpected advantage of the mechanism used in the module 100 derives from its ability to directly drive both rotational and orbital motion of the backing plate 124. As a result, each rotation of the backing plate 124 corresponds to a certain fixed number of rotations of the spindle 110. Because the ratio between rotation rate of the backing plate 124 and the spindle 110 is constant irrespective of the drag resistance caused by friction with the substrate, good efficiency of the dual action module 100 can be achieved even with the relatively low drive speeds (or motor speeds) employed by household power drills. Since the motor speeds of the power drill are relatively easy to measure and control, the direct drive mechanism used by the module 100 also provides a high degree of predictability as to the action of the work member 204 when operating the module 100.

Assuming a given drive speed, the provided module 100 also provides a fixed rate of oscillation and fixed eccentric offset unlike some prior art devices. Since these characteristics are precisely defined by the rotational speed of the spindle 110 and the offset $\delta$ between the first and second segments 144, 146 of the spindle 110, the module 100 can be optimized to display a particular degree of eccentricity or rotational speed for a given application. Again, this provides precise control over the dual-action motion of the work member 204.

In preferred embodiments, the drive mechanism of the module 100 nominally operates at a spindle rotation rate that does not exceed 2,500 rotations per minute. More preferably, the drive mechanism nominally operates at a spindle rotation rate that does not exceed 2,200 rotations per minute. Most preferably, the drive mechanism nominally operates at a spindle rotation rate that does not exceed 2,000 rotations per minute. Again, the direct drive mechanism of the assembly 116 enables relatively lower speed motors, including those typically used in household power drills, to power a dual-action device while maintaining consistent and predictable rates of rotation and oscillation.

The module 100 also has improved versatility compared with integrated dual-action devices because it can be used with a wide variety of commercially available power drills 200. For example, the module 100 could be advantageously employed in either a corded or cordless configuration. Because the drive unit powering the module 100 is provided as a separate component, an operator has flexibility in pairing the module with a power drill 200 with a torque and/or drive speed that is best suited for the application at hand. Since many consumers already possess a power drill, the module 100 provides significant cost savings to these consumers since the inclusion of a drive motor is obviated, reducing complexity and manufacturing costs associated therewith. The module 100 is also relatively compact allowing it to be easily packaged, stored and transported.

Kits and assemblies including the module 100 are also contemplated. For example, the module 100 may be bundled as part of a kit containing one or more work members 204. For example, in abrasive applications, the module 100 could be provided with a selected set of abrasive discs having progressively increasing grit size (or coarseness) suitable for achieving wide ranges of cut and finish. In automotive care, the set of work members 204 could include pads of different materials such as wools and various grades of open-celled foams. As another variant, the kit could include one or more liquid compositions for use with the one or more included work members 204. Similarly, kits can also be implemented with respect to the intermediary pads 202, which can be provided with variations in thickness, diameter, and/or stiffness.

All of the patents and patent applications mentioned above are hereby expressly incorporated by reference. The embodiments described above are illustrative of the present invention and other constructions are also possible. Accordingly, the present invention should not be deemed limited to the embodiments described in detail above and shown in the accompanying drawings, but instead only by a fair scope of the claims that follow along with their equivalents.

What is claimed is:

1. A module adapted for use with a handheld power drill comprising:

a housing having first and second sides;

a rotatable spindle extending outwardly from the first side, the spindle having an outer end adapted for releasable coupling to the power drill;

a direct drive mechanism coupled to the spindle;

a handle coupled to the housing to facilitate control over the module by an operator; and a backing plate located adjacent the second side and engaged to the direct drive mechanism whereby rotation of the spindle directly drives rotation of the backing plate, the rotation occurring along a circular orbital path relative to the housing, wherein the module lacks any structure that couples the housing to the power drill and prevents rotation of the housing during operation.

2. The module of claim 1, wherein the direct drive mechanism comprises an internal ring gear mechanism.

3. The module of claim 1, further comprising a work member engaged to the backing plate.

4. The module of claim 3, wherein the work member is selected from the group consisting of: an abrasive disc, brush, polishing pad, buffing pad, or cleaning pad.

5. The module of claim 4, further comprising an intermediary pad disposed between the work member and the backing plate.

6. The module of claim 5, wherein the intermediary pad comprises a compressible pad.

7. The module of claim 5, wherein the intermediary pad and work member have respective coupling surfaces adapted for releasable engagement to each other.

8. The module of claim 1, wherein the backing plate rotates in a direction counter to its orbital direction.

9. The module of claim 7, wherein the spindle and backing plate rotate at different rates according to a predefined ratio ranging from 5:1 to 15:1.

10. The module of claim 9, wherein the pre-defined ratio ranges from 8:1 to 10:1.

11. The module of claim 1, wherein the backing plate is generally planar and the spindle has a rotational axis, the rotational axis forming a fixed angle relative to the plane of the backing plate relative to during operation of the abrading device.

12. The module of claim 11, wherein the fixed angle is approximately 90 degrees.

13. A dual-action device kit comprising:

a module adapted for use with a handheld power drill, the module comprising:

a housing having first and second sides;

a rotatable spindle extending outwardly from the first side, the spindle having an outer end adapted for releasable coupling to the drill device;

a handle coupled to the housing to facilitate control over the module by an operator; and a backing plate adjacent the second side and engaged to the spindle wherein rotation of the spindle causes the backing plate to rotate along a circular orbital path relative to the housing, wherein the module lacks any structure that couples the housing to the power drill and prevents rotation of the housing during operation.

14. The kit of claim 13, the module further comprising an internal ring gear mechanism in mutual engagement with both the spindle and the backing plate.

15. The kit of claim 13, further comprising one or more work members adapted for releasable engagement to the backing plate.

16. A method of processing a substrate comprising:

providing a module having a housing, a rotatable spindle extending outwardly from a first side of the housing and received in the housing, a handle coupled to the housing, and a work member engaged to the spindle and extending along a second side of the housing, the module lacking any structure that couples the housing to the power drill and prevents rotation of the housing during operation;

releasably coupling a handheld power drill to the spindle;

placing the work member against the substrate; and rotating the work member, using the drill device, along a circular orbital path across the surface of the substrate while holding the handle to prevent rotation of the housing during operation.

17. The method of claim 16, wherein the work member is selected from the group consisting of: an abrasive disc, brush, polishing pad, buffing pad, and cleaning pad.

18. The method of claim 16, wherein rotating the work member comprises rotating the spindle at a nominal rate not exceeding 2500 rotations per minute.

* * * * *